US005914176A

United States Patent [19]

Myers

[11] Patent Number: 5,914,176

[45] Date of Patent: Jun. 22, 1999

[54] COMPOSITE DESIGNS FOR ATTACHMENT TO AN ARTICLE OF FABRIC

[75] Inventor: Robert A. Myers, Huntsville, Tex.

[73] Assignee: M & M Designs, Inc., Huntsville, Tex.

[21] Appl. No.: 08/844,299

[22] Filed: Apr. 18, 1997

[51] Int. Cl.[6] ..... B32B 9/00

[52] U.S. Cl. ..... 428/195; 428/88; 428/90; 428/102; 428/190; 428/200; 428/201; 428/204; 428/206; 428/207; 428/914; 156/72; 156/241; 156/248; 2/275

[58] Field of Search ..... 428/88, 90, 200, 428/206, 914, 190, 102, 201, 204, 207; 156/72, 241, 291, 248; 2/275

[56] References Cited

U.S. PATENT DOCUMENTS 4,215,991 8/1980 Steiger ..... 8/115
5,047,103 9/1991 Abrams et al. ..... 156/72
5,207,851 5/1993 Abrams ..... 156/230
5,635,001 6/1997 Mahn, Jr. ..... 156/93

*Primary Examiner*—Bruce H. Hess
*Assistant Examiner*—Abraham Bahta
*Attorney, Agent, or Firm*—Bill B. Berryhill

[57] ABSTRACT

An article of composite design for attachment to another fabric article, comprising an underlying layer of twill on one side of which an ink portion of the composite design has been screen printed and heat cured. The twill is cut into a desired shape so that the twill and the ink portion form the composite design, the portion of the twill without ink printed thereon forming a substantial portion of the composite design. Methods of making and attaching the composite design are disclosed.

6 Claims, 1 Drawing Sheet

COMPOSITE DESIGNS FOR ATTACHMENT TO AN ARTICLE OF FABRIC

BACKGROUND OF THE INVENTION

1. Field of the Invention

The present invention pertains to preselected designs which are attachable, by sewing or by application of heat and/or pressure, to an article of fabric. More specifically, the present invention pertains to preselected designs which comprise a layer of material on one side of which an ink portion of the composite design has been printed and which, after being cut into a desired shape, may be attached to the article of fabric. In particular, the present invention pertains to articles of composite design and methods of making and attaching such composite designs to articles of fabric such as athletic uniforms.

2. Description of the Prior Art

Materials and methods for transferring a design to another object have long been in existence. Many new materials and methods have been developed in recent years for specific purposes. For example, heat transfer laminates have become increasingly popular for imprinting designs on fabric articles such as t-shirts, jackets, dresses, caps, etc. Most of these recent methods of transfer of printing are accomplished with a laminate having a base sheet or layer of some type of paper, cellophane, synthetic resin, etc. The base sheet or layer would be typically coated with some type of adhesive on top of which a layer of some type of ink may be printed or deposited. The ink layer is in the form of a design which is to be transferred or imprinted on the fabric of the article on which the design is desired. Then the ink design layer is coated with a second adhesive layer.

The laminate is placed against the fabric of the article on which the design is desired with the second adhesive layer in contact therewith. Then heat and pressure are applied to the base sheet or layer side of the laminate until the heat is sufficient to melt the second adhesive layer enough to bond the design to the fabric and until the first adhesive layer is melted enough to allow release of the base sheet or layer. After application of heat and pressure, the base sheet is removed and the remaining components of the laminate are allowed to cool, leaving the design imprinted or permanently bonded to the fabric.

While these previous art transfer designs and methods are suitable for many applications, they are not acceptable for others. For example, designs and lettering for college and professional athletic uniforms are typically made from multiple layers of twill which are sewed to the athletic garment. A sewn multi-color twill design would require two or more members which are sewn to the garment and each other. Although the appearance of such a design is one of quality and depth, it is very time consuming to manufacture and more expensive than other methods of design attachment. It also adds considerable weight to the garment.

Garments such as athletic uniforms on which designs have been directly or indirectly imprinted are generally perceived as a lower quality product and are priced accordingly. Obviously, there is a need or demand for composite designs and methods of attachment to an article of fabric, such as an athletic uniform, which would give the appearance of sewed composite twill designs without the manufacturing and expense problems associated therewith. One type of transfer and the method of making such for this purpose is disclosed in U.S. Pat. No. 5,207,851. In this method, the composite design is formed from a flock component and a layer of twill material. First a design is flocked onto a paper substrate having a release adhesive. A binder and hot melt adhesive is applied to the flock design and the hot melt adhesive is applied to a second paper substrate coated with a release adhesive. The twill sheet is bonded to the hot melt layer which was applied to the second paper substrate. The twill is die cut so that is smaller than the outside dimensions of the flock but greater than the interior opening in the flock. The twill is adhesively bonded to the hot melt layer of the flock.

SUMMARY OF THE PRESENT INVENTION

The present invention provides an article of composite design for attachment to another fabric article such as an athletic uniform. The article of composite design of the present invention includes an underlying layer of twill on one side of which an ink portion of the composite design has been screen printed and heat cured, the twill being cut into a desired shape so that the twill and the ink portion form the composite design. The portion of the twill without ink printed thereon forms a substantial portion of the composite design.

The composite design of the present invention is made by first providing a layer of twill and screen printing an ink portion of the composite design on one side of the twill with a preselected ink mixed with an adhesive. The ink portion of the composite design is heat cured and the twill is cut into a desired shape so that the twill and ink portion form the composite design. The composite design is then attached to the article of fabric by sewing or by application of heat and/or pressure.

Thus, the resulting printed twill appears as multiple layers of sewn-together twill without the disadvantages of conventional sewn-together twill designs. Time consumed in manufacturing, particularly sewing time, is substantially reduced. The resulting composite design of the present invention is slightly more expensive than designs which are directly or indirectly imprinted on the fabrics. However it is much less expensive than the conventional sewn designs, filling a price category between multiple layered sewn twill and imprinted garments. Furthermore, the printed twill is extremely durable under game or practice conditions, particularly in professional sports. In addition, the weight of the uniforms on which it is used is reduced. Many other objects and advantages of the invention will be apparent from reading the description which follows in conjunction with the accompanying drawings.

DESCRIPTION OF PREFERRED EMBODIMENTS

Figure 1:
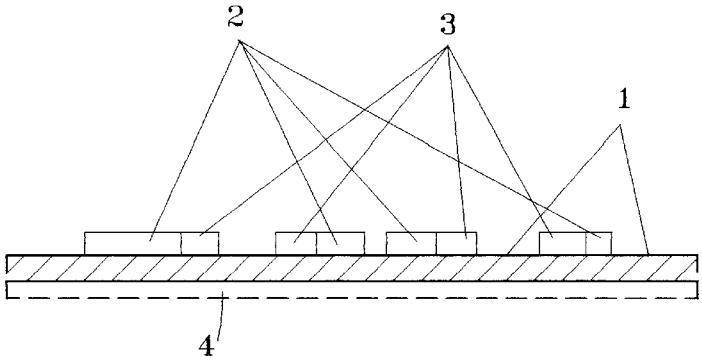
FIG. 1 is a cross-sectional view of a composite design for attachment to an article of fabric, according to a preferred embodiment of the invention, comprising a layer of twill and ink printed portions of said design thereon.
Figure 2:
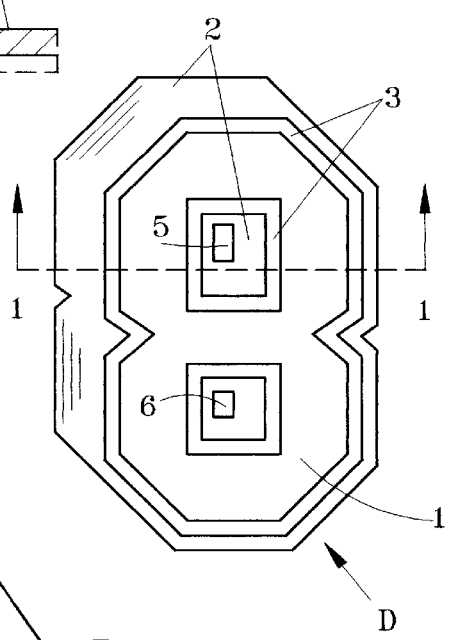
FIG. 2 is a plan view of a composite design, such as the one shown in FIG. 1, according to a preferred embodiment of the invention.

Referring first to FIG. 1, there is shown cross-sectional portions of components which form a composite design D, such as shown in FIG. 2. The composite of FIG. 1 comprises an underlying layer of twill 1 on which ink portions 2, 3 have been printed. The ink portion 2 represents one color and the ink portion 3 represents another color.

Each of the ink portions is independently screen printed on one side of the layer of twill 1 with a preselected ink (vinyl, vinyl plastisol, water based, dye, etc.) mixed with an adhesive. Many types of inks and adhesives are acceptable. In a preferred embodiment the ink is plastisol based and the adhesive is a nylon catalyst adhesive. After the ink is printed on the twill, it is heat cured or fused using heat ranging in temperature between 200 degrees F. and 400 degrees F. After the ink portion of one color 2 has been imprinted and cured, another portion of another color 3 may be screen printed and heat cured in the same manner. Additional colors and portions of the design may be imprinted and cured in the same manner. The preselected inks, once cured, do not mix with later deposited inks. Therefore portions of the design of different color may be printed adjacent to, overlying or overlapping previously printed and cured ink portions. In the exemplary embodiment of FIG. 1, the second color portion 3 is shown printed adjacent to the first colored portion 2.

Depending upon the method by which the composite design D is to be attached to the article of fabric, the side of the twill opposite the printed side thereof may or may not be provided with a coating 4 of heat or pressure sensitive material.

After the ink portions of the composite design D have been printed and heat cured on one side of the layer of twill 1, the twill 1 is cut into a desired shape to form a composite design, such as the composite design D of FIG. 2. It will be noted that the portion of the twill 1 without ink printed thereon forms a substantial portion of the composite design D. In addition, portions of the twill may be cut away in the interior of the design such as at 5 and 6 in FIG. 2. The shape of the composite design may be cut through the ink 2, 3 and twill 1 or the twill only.

Figure 3:
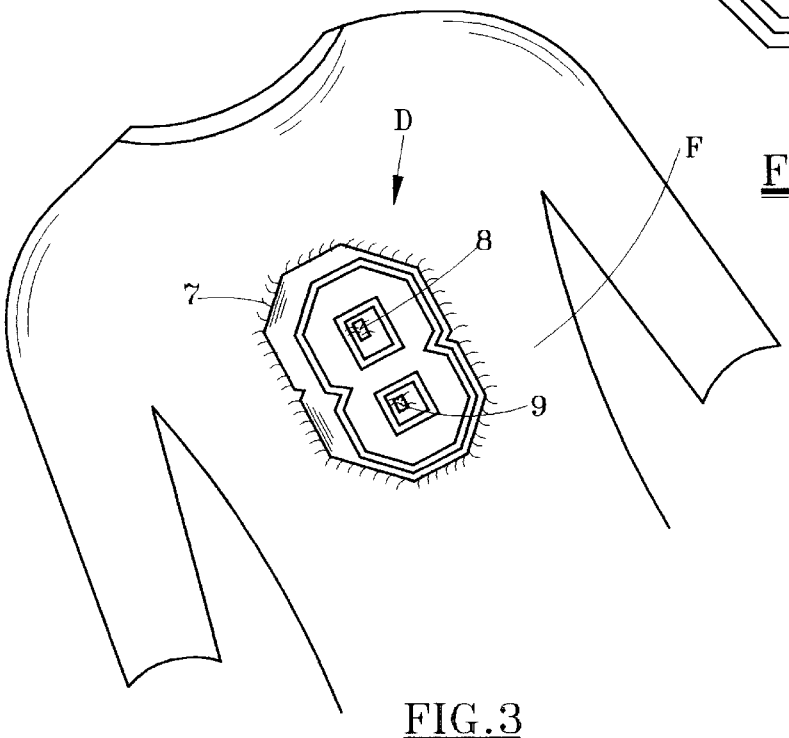
FIG. 3 is a pictorial illustration of the composite design of FIGS. 1 and 2 attached to an article of fabric.

Finally, the composite design D is attached to a fabric garment F such as the athletic shirt of FIG. 3. If the twill 1 has been coated with a heat or pressure sensitive material, such as illustrated at 4 in FIG. 1, it may be attached to the fabric F with heat and/or pressure of required amounts. To give an even more realistic appearance of multiple layers of sewn twill, the outer and inner outlines of the composite design only may be sewn to the fabric F such as illustrated by the stitching 7, 8 and 9 in FIG. 3.

Thus, the present invention provides an article of composite design for attachment to a fabric article which comprises a layer of twill and ink compositions. The resulting product closely resembles multi-layered sewn twill but at substantially reduced cost. It also provides other advantages over multiple-sewn layers of twill and over directly and indirectly imprinted transfers.

Several preferred embodiments of the invention have been described herein. However, many variations thereof can be made by those skilled in the art without departing from the spirit of the invention. Accordingly, it is intended that the scope of the invention be limited only by the claims which follow.

I claim:

1. An article of composite design for attachment to another fabric article; said article of composite design comprising a single layer of twill having upper and lower surfaces and on the upper surface of which an ink portion of said composite design has been screen printed and heat cured leaving a portion of said upper surface without ink, said twill being cut into a desired shape so that said twill and said ink completely form said composite design, the portion of said twill without ink printed thereon forming a substantial portion of said composite design.

2. An article of composite design as set forth in claim 1 in which one or more additional ink portions form said composite design having been screen printed and heat cured on said upper surface of said twill.

3. An article of composite design as set forth in claim 1 in which said ink portion of said composite design has been formed from a plastisol based ink mixed with a nylon catalyst adhesive.

4. An article of composite design as set forth in claim 1 in which said layer of twill is selected from one of a group of polyamide and polyester materials.

5. An article of composite design as set forth in claim 1 in which the lower surface of said layer of twill is provided with a heat sensitive coating so said composite design may be attached to said another fabric article by heating thereof.

6. An article of composite design as set forth in claim 1 in which the lower surface of said layer of twill is provided with a pressure sensitive coating so that said composite design may be attached to said another fabric article by applying sufficient pressure thereto.

* * * * *